United States Patent [19]

Sato et al.

[11] 4,326,391

[45] Apr. 27, 1982

[54] RANKINE-CYCLE-ENGINE-DRIVEN COOLING-AND-HEATING SYSTEM

[75] Inventors: Eiji Sato, Shimoinayoshi; Nobukatsu Arai, Ushikumachi; Hideki Tanaka, Shimoinayoshi; Toshihiko Fukushima, Shimoinayoshi; Tadakatsu Nakajima, Shimoinayoshi, all of Japan

[73] Assignee: Hitachi, Ltd., Tokyo, Japan

[21] Appl. No.: 180,638

[22] Filed: Aug. 25, 1980

[30] Foreign Application Priority Data

Aug. 24, 1979 [JP] Japan ..... 54-107264

[51] Int. Cl.[3] ..... F25D 9/00

[52] U.S. Cl. ..... 62/402; 60/657; 62/469; 62/470

[58] Field of Search ..... 62/84, 468, 469, 470, 62/402; 60/657

[56] References Cited

U.S. PATENT DOCUMENTS

| | | | |
|---|---|---|---|
| 3,259,176 | 7/1966 | Rice et al. | 165/28 |
| 3,408,828 | 11/1968 | Soumerai et al. | 62/470 |
| 3,728,857 | 4/1973 | Nichols | 62/469 |

*Primary Examiner*—Ronald C. Capossela

*Attorney, Agent, or Firm*—Craig and Antonelli

[57] ABSTRACT

In a Rankine-cycle-engine-driven cooling-and-heating system comprising a power generating cycle including at least an expander, an oil separator, a condenser and a generator and a cooling-and-heating cycle including at least a compressor, an oil separator, a condenser, an expansion means and an evaporator, the housings of the expander and the compressor are so securely joined that a hermetically sealed space may be defined between them. This space is used as an oil separator which is common to both the cycles and is communicated with the outlet port of the expander and the discharge port of the compressor. As a result, the system can be made considerably compact in size as compared with the prior art systems in which the oil separator is disposed outside of the expander and the compressor.

6 Claims, 4 Drawing Figures

RANKINE-CYCLE-ENGINE-DRIVEN COOLING-AND-HEATING SYSTEM

BACKGROUND OF THE INVENTION

1 Field of the Invention

The present invention relates to a Rankine-cycle-engine-driven cooling-and-heating system especially of the type in which a Rankine-cycle engine is combined with a compressor of a cooling-and-heating cycle.

2 Description of the Prior Art

A Rankine-cycle-engine-driven cooling-and-heating system is disclosed in for example U.S. Pat. No. 3,259,176.

This system consists of a power generating cycle comprising an expander, an oil separator, a condenser, a refrigerant pump and a generator (including a boiler) and a cooling-and-heating cycle comprising a compressor driven by the power produced by the expander, an oil separator, a condenser, an expansion valve and an evaporator.

In this system, the expander and the compressor are disposed separately so that prior to joining their rotary shafts, the latter must be correctly aligned axially.

In addition, the expander and the compressor are joined through a coupling so that a space is left between them.

Furthermore, the oil separator is provided as a pressure vessel exterior to the expander or compressor.

As described above, there has not been made any attempt to package the component parts of the system.

SUMMARY OF THE INVENTION

In view of the above, the primary object of the present invention is to provide a Rankine-cycle-engine-driven cooling-and-heating system which is very compact in size.

Another object of the present invention is to provide the system in which the space required for installation of an expander, a compressor and an oil separator can be minimized.

A further object of the present invention is to provide the system which can eliminate the step for attaining the correct axial alignment of the shafts of the expander and the compressor.

A yet another object of the present invention is to provide the system which can minimize the frictional losses of the expander and the compressor.

To the above and other ends, briefly stated, the present invention provides a Rankine-cycle-engine-driven cooling-and-heating system in which a housing of an expander is securely joined to that of a compressor in such a way that a hermetically sealed space may be defined between them, which is used as an oil separator.

DESCRIPTION OF THE PREFERRED EMBODIMENT

Figure 1:
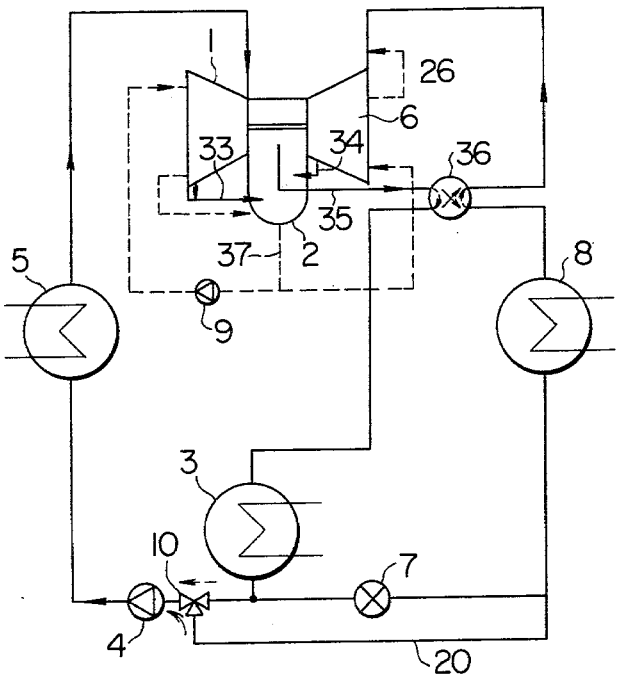
FIG. 1 is a diagrammatic view of a preferred embodiment of a Rankine-cycle-engine-driven cooling-and-heating system in accordance with the present invention.

Referring first to FIG. 1, a power generating cycle consists of an expander 1, an oil separator 2, a first heat exchanger 3, a refrigerant pump 4, a generator 5, an oil pump 9 and a three-way valve 10. A cooling-and-heating cycle comprises a compressor 6, the oil separator 2, the first heat exchanger 3, an expansion valve 7 and a second heat exchanger 8.

The oil separator 2 and the first heat exchanger 3 are used in common in both the power generating cycle and the cooling-and-heating cycle.

One of the ports of the three-way valve 10 is communicated through a line 20 with the second heat exchanger 8. A four-way valve 36 is communicated with the suction port 26 of the compressor 6, the outlet of the oil separator 2 and the first and second heat exchangers 3 and 8.

Boiler, exhaust steam from a factory or hot water is supplied as heat input to the generator 5.

The first and second heat exchangers 3 and 8 are of the water cooling type having a bank of tubes for passing cooling water or cooled water or of the air cooling type having a fan motor.

Figure 2:
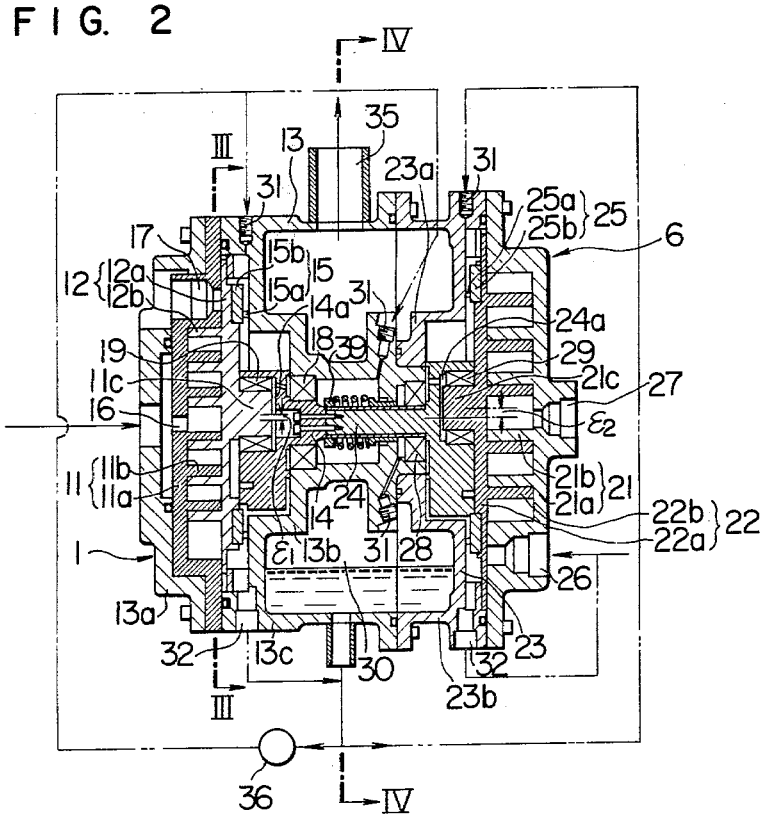
FIG. 2 is a vertical sectional view of an expander, a compressor and an oil separator of the system which are assembled as a unitary construction.
Figure 3:
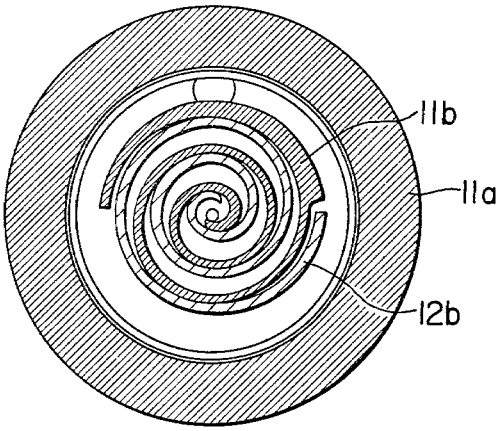
FIG. 3 is a sectional view taken along the line III—III of FIG. 2.
Figure 4:
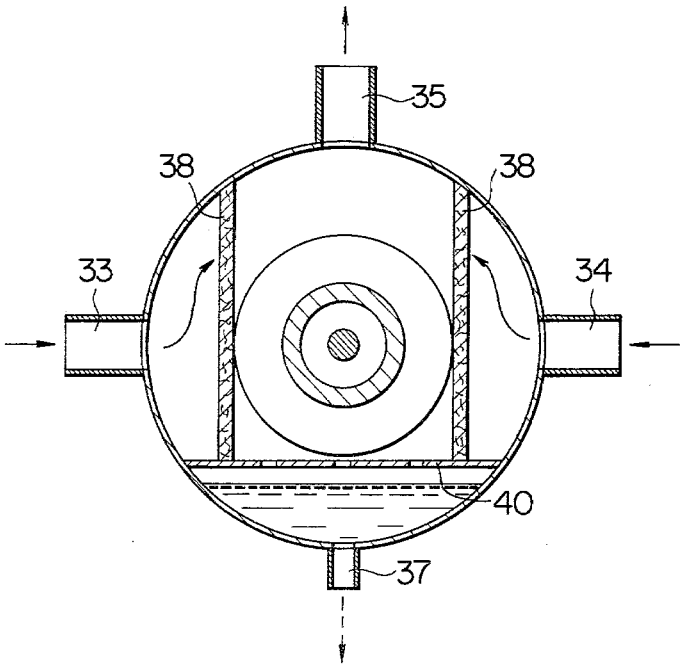
FIG. 4 is a cross sectional view taken along the line IV—IV of FIG. 2.

Referring to FIGS. 2 through 4, the expander 1 comprises a stationary scroll 11, a whirling or swirling scroll 12, a housing 13, a rotary shaft 14 and a self-rotation preventive means 15. The compressor 6 comprises a stationary scroll 21, a whirling or swirling scroll 22, a housing 23, a rotary shaft 24 and a self-rotation preventive means 25. As best shown in FIG. 3, the stationary scroll 11 or 21 consists of an end plate 11*a* or 21*a* and a spiral coiled (involute) lap 11*b* or 21*b* extended therefrom in parallel with the axis thereof. In like manner, the swirling scroll 12 or 22 consists of an end plate 12*a* or 22*a* and a spiral coiled (involute) lap 12*b* or 22*b* extended therefrom in parallel with the axis thereof. The stationary scroll 11 has an inlet 16 at its center and an outlet 17 positioned adjacent to its periphery. In like manner, the stationary scroll 21 has a discharge port at its center and the suction port 26 close to its periphery. The direction of the spiral coiled lap 11*b* or 12*b* is opposite to that of the spiral coiled lap 21*b* or 22*b*.

The housing 13 comprises an end section 13*a* surrounding the stationary scroll 11, an intermediate section 13*b* surrounding not only the swirling scroll 12 but also the rotary shaft 14 and an outer wall section 13*c*. The rotary shaft 24 has a boss hole 24*a* at its head into which is fitted the boss 21*c* of the swirling scroll 21. A bearing 29 is interposed between the boss 21*c* and the hole 24*a*. The axis of the boss 21*c* and the hole 24*a* coincides with that of the swirling scroll 21 but is offset by $\epsilon_2$ from the axis of the rotary shafts 24 and 14.

The self-rotation preventive means 15 and 25 are substantially similar in construction, each comprising an Oldham's ring 15*a* or 25*a*, an Oldham's key 15*b* or 25*b* joined to the swirling scroll 11 or 21 and another Oldham's key (not shown) joined to the housing 13 or 23.

The Oldham's ring 15*a* has a first groove (not shown) for engagement with the first Oldham's key 15*b* and a second groove (not shown) for engagement with the second Oldhams's key. These first and second grooves are perpendicular to each other. The Oldham's ring 25*a* is also substantially similar in construction to 15*a*.

The housings 13 and 23 are provided with oil inlets 31 and oil outlets 32. Joined to the outer wall section 13*c* of the housing 13 are a line of pipe 33 communicated with the outlet 17, a line of pipe 34 communicated with the discharge port 27, a line of pipe 35 communicated with the four-way valve 36, and a line of pipe 37 communicated with the oil pump 9. Disposed within a chamber 30 are filter elements 38 and a perforated disk 40 as shown in FIG. 4. The filter elements 38 are disposed in such a way that they may be removed. A mechanical seal 39 is mounted on the rotary shaft 14 or 24 extended through the housing 13. If it is needed to cool the oil, an oil cooler may be added adjacent to the outlet of the oil separator 2.

Next the mode of operation of the system with the above-described construction will be described.

Refrigeration Cycle

Rhe four-way valve 36 and the three-way valve 10 are so set that a working fluid flows in the directions indicated by broken line arrows in FIG. 1.

The first heat exchanger 3 operates as a condenser while the second heat exchanger 8, as an evaporator.

High-temperature and high-pressure vapor of a refrigerant, such as a fluorochlorohydrocarbon generated in the generator 5 flows through the inlet 16. Because of the expansion of the gas, the space defined between the stationary and swirling scrolls 11 and 12 is gradually increased in volume and the swirling scroll 12 is caused to rotate in the counterclockwise direction in FIG. 3, thereby producing the rotating force. The rotating force thus produced is transmitted through the rotary shafts 14 and 24 to the swirling scroll 22 so that the latter is rotated. The space defined between the stationary and swirling scrolls 21 and 22 is gradually reduced in volume. By virtue of the above-described action which is repeatedly cycled, the gas introduced through the inlet 26 is compressed and discharged through the discharge port 27. The compressed gas discharged through the port 27 and the gas discharged through the outlet 17 are equal in pressure and are directed into the space or chamber 30 in the oil separator. Oil entrained in the gas is trapped by the filter elements 38. Even when no filter element is provided, the velocity of the gas drops suddenly to a considerable extent when the gas enters the oil separator. As a result, the oil drops entrained in the gas drop by their own weights and subsequently are separated from the gas. The gas, which is now free from the oil drops, flows through the line 35 into the condenser 3. The oil, which is separated from the gas, accumulates at the bottom of the chamber 30 and is forced to flow by the oil pump 9 into the expander 1 for lubricating its rubbing parts. The oil is also supplied to the compressor 6 for lubricating its rubbing parts due to the difference between the discharge pressure (pressure in the chamber 30) and the suction pressure of the compressor 6.

In the condenser 3, the gas is cooled and liquefied. Part of the liquid refrigerant flows through the expansion valve 7 into the evaporator 8, in which the liquid refrigerant is expanded, thereby producing cooling by absorbing heat from the surrounding air or water.

Part of the condensed refrigerant is fed by the refrigerant pump 4 into the generator 5 in which the liquid refrigerant is heated and vaporized.

Heating Cycle

The four-way valve 36 and the three-way valve 10 are so set that the working fluid flows in the directions indicated by solid-line arrows in FIG. 1.

The first heat exchanger 3 operates as an evaporator while the second heat exchanger 8, as a condenser.

The operation of the heating cycle is substantially similar to that of the refrigeration cycle described above, so that only the flows of the refrigerant through various devices will be described. Furthermore, the mode of operation of the power cycle is substantially similar to that in the refrigeration cycle described above.

The compressed gas from the compressor 6 flows into the oil separator 2 and through the four-way valve 36 into the condenser 8 in which the refrigerant discharges heat and becomes liquid, thereby producing heating.

The liquid refrigerant flows through the line 20 and the three-way valve 10 into the pump 4. It also flows through the expansion valve 7 into the evaporator 3 in which the liquid refrigerant absorbs the ambient heat and evaporates. The gas from the evaporator 3 flows through the four-way valve 36 into the compressor 6 in which the gas is compressed.

The effects, features and advantages of the present invention may be summarized as follows:

(1) The housings of the expander and compressor are securely joined so that the space between the expander and compressor can be reduced and subsequently the system can be made very compact in size.

(2) The space between the expander and compressor housings is hermetically sealed and used as an oil separator. As a result, the overall axial length of the expander and compressor can be reduced. In addition, the overall system can be made considerably compact in size as compared with the systems in which the oil separators are disposed exterior of the expander and compressor.

(3) The chamber or compartment of the oil separator is partly defined by the housings of the expander and compressor. As a result, a high pressure vessel can be defined by a mere addition of the outer wall section.

(4) Because the expander and compressor housings are securely joined as described above, the step for aligning the expander and the compressor can be much simplified. Especially in the case of the re-assembly after the disassembly for maintenance or repairs, the step for attaining the alignment between them can be eliminated.

(5) Only one mechanical seal is needed and the bearings can be reduced to a minimum number. As a result, mechanical failures can be reduced to a minimum.

What we claim is:

1. A Rankine-cycle-engine-driven cooling-and-heating system comprising a scroll type expander including a stationary scroll having an end plate, a spiral coiled lap extended in parallel with the axis of said end plate, an inlet for a working fluid, and an outlet for said working fluid; a swirling or rotating scroll having an end plate, and a spiral coiled lap extended in parallel with the axis of said end plate and in mating relationship with said spiral coiled lap of said stationary scroll;

a rotary shaft carrying said swirling or rotating scroll;

a self-rotation preventive means for preventing the self-rotation of said swirling or rotating scroll, and a housing joined to said stationary scroll; a scroll type compressor including a stationary scroll having an end plate, a spiral coiled lap extended in parallel with the axis of said end plate, and an inlet and an outlet;

a swirling or rotating scroll having an end plate, and a spiral coiled lap extended in parallel with the axis of said end plate and in mating relationship with said spiral coiled lap of said stationary scroll, a rotary shaft which carries said swirling or rotating scroll and is securely joined to said shaft of said swirling or rotating scroll or said scroll type expander, a self-rotation preventive means for preventing the self-rotation of said swirling or rotating scroll, and a housing joined to said stationary scroll and to said housing of said scroll type expander;

an oil separator having a hermetically sealed space defined by said housings of said expander and said compressor;

a first heat exchanger which operates as a condenser in the case of the refrigeration cycle but as an evaporator in the case of the heating cycle;

a second heat exchanger which operates as an evaporator in the case of the refrigeration cycle but as a condenser in the case of the heating cycle;

a refrigerant pump;

an expansion means;

an oil supply system consisting of an oil pump and an oil line;

a generator for heating the refrigerant discharged from said refrigerant pump, thereby evaporating the same; and a seal means mounted on said rotary shafts between the housings of said expander and said compressor for gas-tightly isolating between said expander and said compressor.

2. A Rankine-cycle-engine-driven cooling-and-heating system as set forth in Claim 1, wherein said oil separator is communicated with said outlet for said working fluid of said expander and said outlet of said compressor so as to serve as a common oil separator for both of said expander and said compressor.

3. A Rankine-cycle-engine-driven cooling-and-heating system as set forth in claim 1 or 2 further comprising filter elements disposed in said oil separator for separating oil drops entrained in the gaseous refrigerant flowing therein from said expander and said compressor.

4. A Rankine-cycle-engine-driven cooling-and-heating system as set forth in claim 3, wherein said filter elements extend substantially vertically.

5. A Rankine-cycle-engine driven cooling-and-heating system as set forth in claim 3, wherein said oil line of said oil supply system comprises a first oil line connecting said oil separator with an oil inlet of said compressor and a second oil line connecting said oil separator with an oil inlet of said expander, said oil pump being disposed in said second oil line.

6. A Rankine-cycle-engine-driven cooling-and-heating system as set forth in claim 1 or 2, wherein said oil line of said oil supply system comprises a first oil line connecting said oil separator with an oil inlet of said compressor and a second oil line connecting said oil separator with an oil inlet of said expander, said oil pump being disposed is said second oil line.

* * * * *